US005657742A

United States Patent [19]

Greenall

[11] Patent Number: 5,657,742

[45] **Date of Patent: *Aug. 19, 1997**

[54] SOLID FUEL HEATING DEVICE

[76] Inventor: Jonathan Greenall, More Works, Squilver Hill, Bishops Castle, Shropshire SY9 5HH, United Kingdom

[ * ] Notice: The term of this patent shall not extend beyond the expiration date of Pat. No. 5,496,836.

[21] Appl. No.: 513,933

[22] PCT Filed: Jun. 18, 1993

[86] PCT No.: PCT/GB93/01302

§ 371 Date: Oct. 23, 1995

§ 102(e) Date: Oct. 23, 1995

[87] PCT Pub. No.: WO94/20795

PCT Pub. Date: Sep. 15, 1994

Related U.S. Application Data

[63] Continuation-in-part of Ser. No. 104,058, Sep. 24, 1993, Pat. No. 5,469,836.

[30] Foreign Application Priority Data

Mar. 5, 1993 [GB] United Kingdom ..... 9304529

[51] Int. Cl.[6] ..... F24C 1/14

[52] U.S. Cl. ..... 126/77; 126/60; 126/193; 126/198

[58] Field of Search ..... 126/77, 76, 190, 126/200, 198, 193, 60, 290, 163 R, 152 B; 237/50, 52; 110/214, 210

[56] References Cited

U.S. PATENT DOCUMENTS

| | | | |
|---|---|---|---|
| 844,292 | 3/1907 | Thruston | 126/77 |
| 907,867 | 12/1908 | Palmer . | |
| 2,337,847 | 12/1943 | Conkell | 126/75 |
| 4,383,517 | 5/1983 | Gillis et al. | 126/77 |
| 4,426,992 | 1/1984 | Martenson | 126/77 |
| 4,475,529 | 10/1984 | Milligan | 126/77 |
| 4,475,533 | 10/1984 | Milligan | 126/279 |
| 4,483,312 | 11/1984 | Martenson | 126/77 |
| 4,611,572 | 9/1986 | Martenson | 126/77 |
| 4,643,165 | 2/1987 | Chamberlain | 126/77 |
| 4,658,801 | 4/1987 | Black | 126/77 |
| 4,665,889 | 5/1987 | Rumens et al. | 126/77 |
| 4,683,868 | 8/1987 | Ferguson | 126/193 |
| 4,766,876 | 8/1988 | Henry | 126/77 |
| 4,856,491 | 8/1989 | Ferguson et al. | 126/77 |
| 4,941,451 | 7/1990 | Gilham | 126/77 |
| 5,469,836 | 11/1995 | Greenall | 126/77 |

FOREIGN PATENT DOCUMENTS

| | | | |
|---|---|---|---|
| 1166911 | 5/1984 | Canada . | |
| 0176323 | 4/1986 | European Pat. Off. . | |
| 0250239 | 12/1987 | European Pat. Off. . | |
| 900982 | 7/1945 | France | 126/77 |
| 87 12 826 U | 3/1988 | Germany . | |
| 490194 | 8/1938 | United Kingdom . | |
| 2172989 | 10/1986 | United Kingdom . | |
| 2189028 | 10/1987 | United Kingdom . | |
| WO84/02568 | 7/1984 | WIPO . | |
| W88/06700 | 9/1988 | WIPO . | |

OTHER PUBLICATIONS

Energy King brochurs, "*Add a Little Warmth to Your Life*" (2 pages).

The Stack Manufacturing Company Limited brochure, "*Stack High Energy Combustion Stoves Vista 640/Combi 640*"(4 pages).

Kent brochure, "*The Fires That Burn Twice*"(7 pages).

Meridian brochure, "*Meridian Wood Burning Heaters*"(8 pages).

Charnwood Fireclass brochure, "*Fireclass—The Fire in a Class of its Own*"(6 pages).

Charnwood Stoves brochures, "*Look into the Features & Versatility of a Multi-Fuel Stove*"(4 pages).

*Primary Examiner*—James C. Yeung

*Attorney, Agent, or Firm*—Baker, Maxham, Jester & Meador

[57] ABSTRACT

A heating appliance has a firebox and an ash chamber. A primary preheating chamber is located beneath the ash chamber. The preheating chamber is U-shaped in cross section and raised portions or arms extend upwardly and define opposite sides of the ash chamber. The upper flat surfaces of the arms serve as mounting blocks to support a grate above the ash chamber.

9 Claims, 2 Drawing Sheets

SOLID FUEL HEATING DEVICE

This is a continuation-in-part of application Ser. No. 08/104,058, filed 24 Sep. 1993, U.S. Pat. No. 5,469,836.

This invention relates to solid fuel heating appliances such as stoves.

Solid fuel heating stoves have been in common use for many hundreds of years. Such stoves usually have a firebox and an ash chamber which may be separate parts of a stove. Alternatively they may be present as parts of one chamber. A common arrangement for a stove is to have a primary air control for updraft air, which is adjustable to control the burn speed of the appliance.

For some time now there has been a desire to improve the emissions of fires so as to reduce environmental pollution of the atmosphere. There have been many attempts worldwide to improve the combustion efficiency of stoves, thereby reducing the smoke emitted by them. Conventional air controls control the burning speed of a fire. However, restricting air to the fire (in order to slow down its burning) causes air starvation and prevents full combustion. I believe that it is important for the temperature in the firebox of a stove to be high in order to achieve fuller combustion, and reduce smoke. Preheating air flow to the fire has a ,considerable advantage in this respect. It has been accepted that preheating combustion air has considerable advantages in promoting a lively and clean burning fire. Many devices have been developed to preheat combustion air and then pass it to parts of the firebox.

It is known to provide an inlet to a stove at the bottom of the stove underneath the ash chamber to provide a means for combustion air to enter a stove. In such a stove an air supply is taken from the external surroundings of the stove through the inlet into a preheating chamber underneath the ash chamber, the air is then fed through a preheating system comprising passageways and conduits, and is eventually fed to an upper portion of the firebox which is disposed above the ash chamber. The preheating chamber and the passageways are at high temperatures relative to the combustion air and as a result the combustion air is preheated before it enters into the firebox.

It remains a problem, however, that the combusted air is never heated to a temperature which is equivalent to the combustion temperature in the fire-box.

It is an aim of the present invention to provide a new heating appliance, and associated methods of use, to attempt to alleviate at least some of the problems discussed above.

According to a first aspect of the invention I provide a heating appliance having a firebox, an ash chamber and preheating means in which the preheating means defines more than one wall of the ash chamber.

The skilled reader will understand that the term "wall" is a general term which covers side, front and rear walls, and top and bottom walls of the ash chamber.

Preferably the preheating means defines the whole of a wall of the ash chamber. The preheating means may provide only part of an ash chamber instead of the full length, or area of the wall. Preferably the preheating means comprises two walls of the ash chamber. However the preheating means may comprise three walls of the ash chamber. Preferably the ash chamber is a trough surrounded by the preheating means on at least two sides. Preferably the trough is U-shaped in cross-section. The trough preferably defines the bottom wall and both side walls of the ash chamber, and preferably defines the whole, or substantially the whole, of the area of the bottom wall, and/or at least one of the side walls. The ash chamber may be defined by raised portions of the preheating means.

Preferably the ash chamber trough is of a uniform cross-section which co-operates with the ash pan. The ash pan may be in sliding engagement with the ash chamber trough.

There may be a primary preheating chamber which lies beneath the ash chamber. Outer portions of the side regions of said preheating chamber may extend upwardly on two or more sides to form a trough or seat arrangement.

Preferably air supply passages extend upwardly from the raised outer portions of the primary preheating chamber. These air supply passages may rise up either side of the interior of the stove and lead to a conventional arrangement to supply preheated combustion air to the firebox.

In this way a greater area of the metal framework which comprises the preheating chamber is presented to the heat conducted away from the ash chamber than would be presented in an arrangement in which the primary preheating chamber is disposed substantially beneath the ash chamber, without extending on a second side (and a third side). Therefore an increased volume of air may be preheated by this arrangement. Additionally upper regions of the raised outer portions are brought to a location which is closer to the firebox, which is the hottest part of the stove, than would be the case in a conventional arrangement.

According to a second aspect of the invention I provide a heating appliance having a firebox, an ash chamber and preheating means in which a portion of the preheating means is adapted to support a grate.

Preferably said portion of the preheating means is raised above other portions of the preheating means.

Additional advantages are in stove construction and design. Conventionally the grate is supported on a rectangular plate having a rectangular hole therein which is located in the stove such that it is a flange or lip which extends around the internal walls of the stove. This lip divides the firebox and the ash chamber and in fact defines the two compartments. Such a feature has to be incorporated separately into the stove, for example by welding it into place onto the interior of the walls of the stove. Furthermore the lip has a leading edge which is prone to corrosion due to the damaging effects of heat and combustion products.

In the invention, the preheating means acts to support the grate. It presents an upper box frame edge or cornerfold of the preheating means to the corrosive effects of the fire which is less prone to damage.

According to a third aspect of the invention I provide a heating appliance having a firebox, an ash chamber and a preheating chamber in which a substantial part of the preheating chamber lies beneath the ash chamber and another part of the preheating chamber extends upwardly to define at least a part of the ash chamber.

In one preferred embodiment the heat generating portions of a stove according to the invention which are in contact with or in close proximity to the ground are completely surrounded by preheating means. Thus those lower portions of the stove are kept cool relative to the ash chamber and this kind of stove is applicable to rest upon a wide variety of floorings without requiring a stand or significant amounts of insulation underneath the stove. This can be a benefit in the use and applicability of the stove, since in some countries building regulations strictly lay down the types of environments in which certain stoves can be located. However, with additional cooling at the bottom of a stove the stove may be applicable to a variety of hearth areas which would not otherwise be possible and may even comprise a wooden floor.

According to a fourth aspect of the invention I provide a heating appliance having a firebox, an ash chamber and a preheating chamber in which the preheating chamber is substantially placed beneath the ash chamber and rises substantially up at least two sides of the ash chamber so as to insulate the lower part of the heating appliance.

A further advantage is provided in an embodiment which has two raised portions of a preheating chamber extending up the side of the ash chamber. Air taken into the preheating chamber beneath the ash chamber rises up the sides of the ash chamber. Oppositely facing raised portions are connected by the bulk of the preheating chamber disposed underneath the ash chamber and the air supplies to each of the raised portions are balanced and symmetrical.

According to a fifth aspect of the invention. I provide a method of preheating an air supply to a stove incorporating the steps of feeding an air supply to a primary air chamber located substantially beneath an ash chamber of the stove which air chamber defines substantially at least two side of the ash chamber and feeding the preheated air supply to a fire in the stove.

An example of a stove embodying the invention will now be described by way of example only with reference to the accompanying drawings of which:

In order to facilitate the understanding of the present application the reader is directed to read our co-pending Patent Application GB 2251302 which shows a stove with some features in common with the present invention. The disclosure and contents of GB 2251302 are hereby incorporated into this Application by reference.

Figure 1:
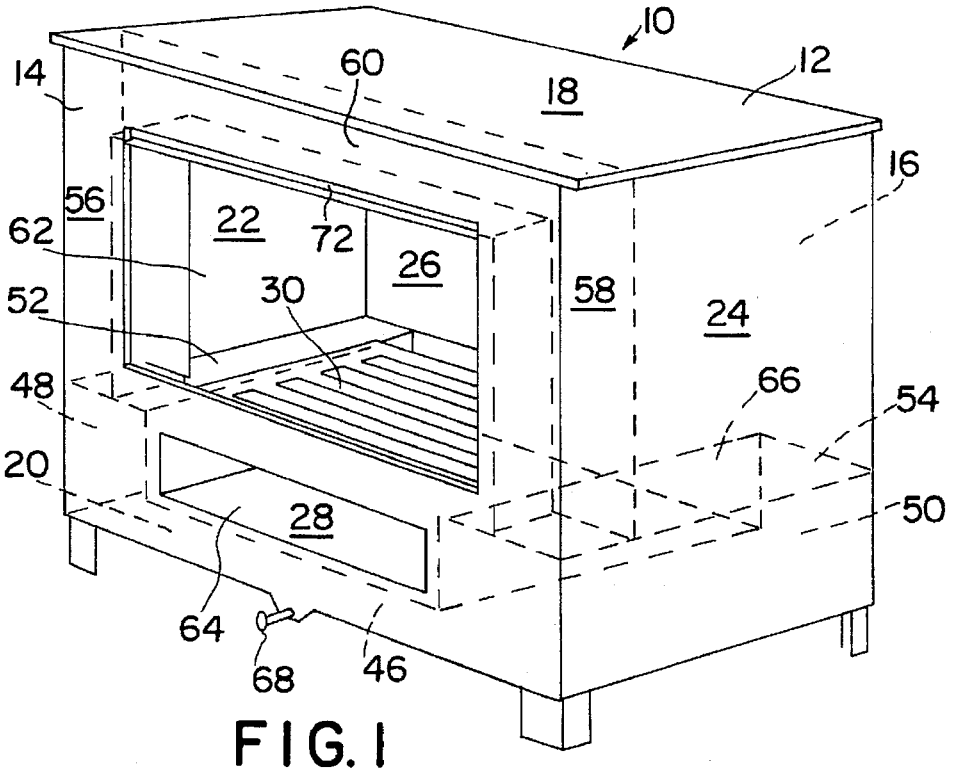
FIG. 1 is a perspective view of the stove which shows internal construction within the stove.

FIG. 1 shows a stove 10 having a body 12 (comprising a front 14, a back 16, a top 18, a bottom 20 and side walls 22 and 24), a firebox 26, an ash chamber 28, a grate 30, an air inlet 32, a door 34 (shown in FIG. 3), an exhaust outlet 36, a deflector plate 38 resting on refractory bricks (not shown) and an insulating panel 40 mounted on the back 16 of the body 12. A primary preheating chamber 46 is located beneath the ash chamber 28. The preheating cheer is U-shaped in cross-section with two arms or raised portions 48 and 50 of the U-shape extending upwardly and surrounding and defining opposite sides of the ash chamber 28. An ash trough 66 is defined by the upper surface of the preheating chamber 46 and is located between the two raised portions 48 and 50. In effect the ash trough 66 forms the ash chamber 28. The raised portions extend upwardly on either side of the ash trough and form flat surfaces 52 and 54 disposed above the ash chamber 28. The two surfaces 52 and 54 lie in a plane. This plane defines the division between the ash chamber 28 and fire-box 26. The flat surfaces 52 and 54 are adapted to receive a grate 30 and support it above the ash chamber 28. Alternatively the preheating chamber 50 may define a pair of shoulders, or shelves, upon which the grate can rest.

Figure 4:
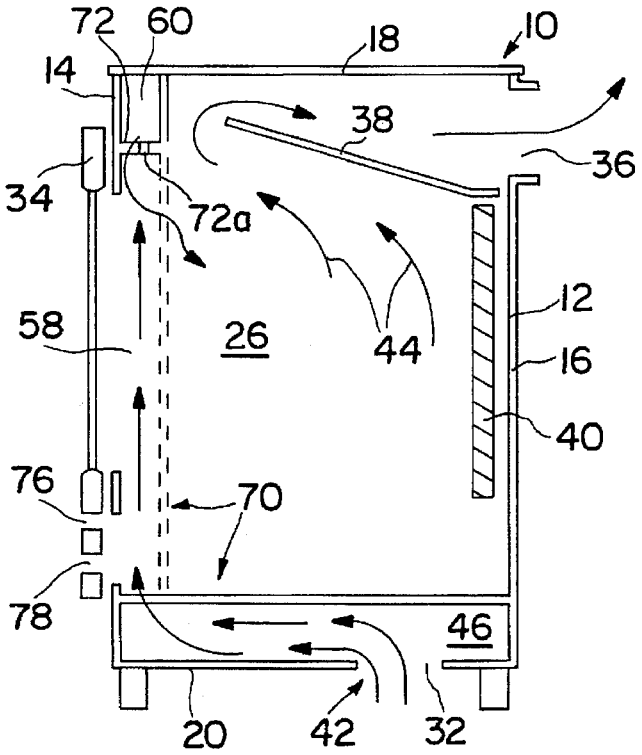
FIG. 4 is a cross-section of the stove along line 4—4 of FIG. 2 showing schematic representations of air flow.

At the forward parts of the raised portions 48 and 50 (internally of the front 14) air passages 56 and 58 extend vertically. The upper end of the air passages are joined together by an air supply chamber 60 which extends across the inside face of the front 14 above a door aperture 62 located in the front 14 of the stove 10. A lower edge 72 of the air supply chamber 60 has a slit 72*a* (FIG. 4) along its length and permits air communication between the air supply chamber 60 and the firebox. The door aperture 62 is located above another aperture, an ash chamber aperture 64 also in the front of the stove 10. The aperture 64 registers with ash chamber 28 or ash trough 66 and provides access to an ash pan (not shown) which sits in the ash chamber to collect any waste that falls through the grate 30.

The air inlet 32, the raised portions 48 and 50, the air passages 56 and 58, the air supply chamber 60 together form a preheating system 70 and are all connected together such that there is a continuous air path by this route from the exterior of the stove 10 to the firebox 26.

As fuel resting on grate 30 burns air inside the firebox 26, combusted air 44 rises and carries smoke with it. The rising air hits the deflector plate 38 and circulates in the firebox before eventually leaving via exhaust outlet 36. A supply of air is controlled by adjusting the position of a mask which lies over the inlet 32 which can be controlled by means of an inlet adjuster 68. This fire can be starved of air by the user if he sets the air inlet 32 incorrectly, and this can cause dirty, smoke. Combusted air flowing out of the exhaust outlet 36 causes a draw on a supply of combustion air into the firebox 26.

Figure 2:
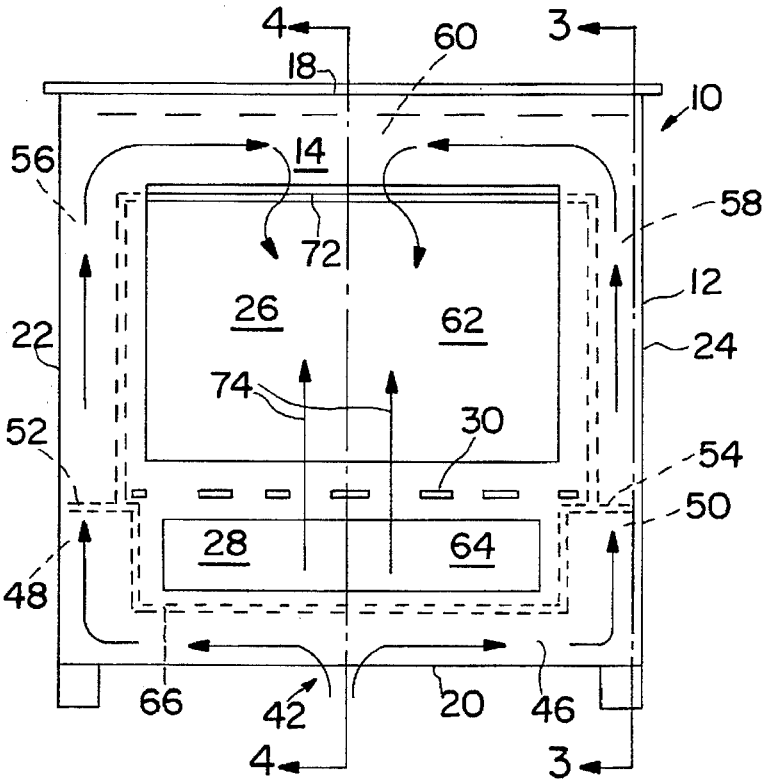
FIG. 2 is a front elevation of the stove (without its door) showing schematic representations of air flow.
Figure 3:
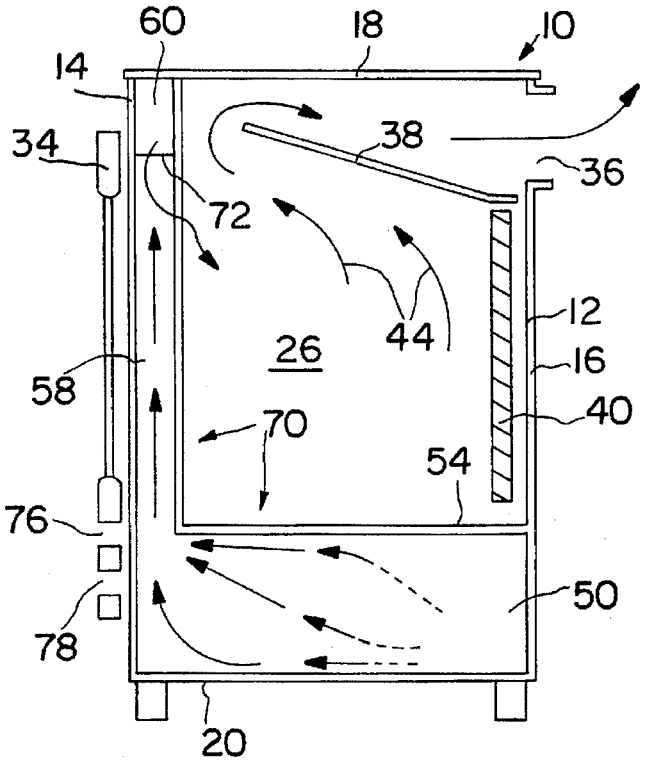
FIG. 3 is a cross-section of the stove along line 3—3 of FIG. 2 showing schematic representations of air flow.

Consequently cold air 42 (shown schematically in FIGS. 2 and 4) enters through the air inlet 32. The cold air is drawn into a primary preheating chamber 46 located beneath the ash chamber 28. As the cold air circulates beneath the ash chamber it is heated by radiation from above, by contact with metal surfaces and by convection. The combustion air spreads out and reaches the raised portions 48 and 50 and rises upwardly due to the draw of air through the preheating system 70. FIG. 3 Shows the air rising in one of the raised portions and drawn further into the pre-heating system 70. The combustion air rises up air passages 56 and 58, into the air supply chamber 60 and is drawn through the lower edge 72 into the firebox 26. The air is preheated to a great extent by the time it enters the firebox 26.

This supply of air provides a downdraught of air into the firebox 26. Another supply of air shown on FIG. 2, updraught air 74, enters the firebox through the grate 30. The updraught; air is drawn through apertures 76 and 78 located in the bottom region of the door 34, it enters into the ash trough 66, flow around the ash pan (which will be present while the fire is in use) undergoes an amount of preheating and rise up through the grate 30 to feed the combustion of fuel lying thereon. It will be appreciated that the updraft air 74 need not enter via the door.

The system of airflows described in the preceding paragraph is known as an airwash system and its purpose is to provide a curtain of non-combusted air to pass downward from the air supply chamber 60 and provide a barrier between the door 34 and combusted air and combustion products. Whilst the combustion air leaves the air supply chamber 60 and heads vertically downward, it interacts with combusted air 44 circulating around the firebox 26 and is further encouraged by this interaction to head downward. In this way combustion products are prevented from reaching the door 34 and condensing on or adhering to the door 34. This keeps a window in the door clean. Furthermore the downdraught of air is directed towards the area in which solid fuel of the fire is burning this providing a good air supply to the fuel.

In obviating the need for a lip the stove is easier to manufacture. Furthermore a stove manufactured to form such a construction is provided with internal separate box section elements which give additional strength to the stove. In any case, while having a lip provides some strengthening the strength of the lip is compromised in the arrangement of our stove shown in GB 2251302 by vertically extending air passages passing through the lip. The present box like construction provides greater strength at the front of the stove which due to one or more large apertures therein, suffers from warping due to heat induced deformation. This can cause difficulties with proper door sealing. The construction provides a more rigid stove front which alleviates this problem.

In removing the lip and providing an ash chamber trough arrangement it is much easier to gain access to the interior of the ash chamber. Consequently an ash chamber of this construction would be much easier to clean.

The manufacture of such a stove should also be more straightforward since the interior of the stove is more accessible. Weld seams are usually made on the inside of a stove and are often difficult to place because they are in inaccessible locations. In this simpler arrangement weld seams can be placed either more easily or in otherwise inaccessible locations so as to produce a more aesthetically pleasing stove.

In utilising the internal volume of the stove, particularly that volume which lies between the external walls of the stove and the ash pan the volume of the stove is used more efficiently and a greater amount of preheated air is available. Accordingly, smaller stoves can be manufactured although the ultimate constraint on miniaturisation of a stove is that there must be a reasonably sized firebox.

The invention is equally applicable to other types of stoves such as a stove in which there is one major chamber which serves as both firebox and ash chamber. In such a stove, ash which is created by combustion forms a deposit straight onto the floor of the major chamber and portions of the preheating means may extend upwardly above the floor of the major chamber. In fact, for such stoves that do not have upwardly extending portions of the preheating means, it may be desirable to convert this type of stove into one which has a separate ash chamber. Separate box sections may be provided to be installed in the major chamber which rest on the floor of the chamber and thus define an ash chamber. These box sections may not be part of the preheating means. Consequently it will be understood that the invention may also be applicable to stoves in which preheating means do not define any substantial part of an ash chamber except perhaps the floor.

What is claimed is:

1. A heating appliance comprising a housing containing a fire-box, an ash-chamber, grate means between said fire-box and said ash chamber, updraught air supply means adapted to provide a supply of updraught air into said fire-box through said grate means, and pre-heating means adapted to deliver a supply of pre-heated air from an air chamber beneath said ash-chamber to an upper region of said fire-box adjacent a door aperture defined in said housing, wherein said air chamber contains an air space, said air space comprising a U-shaped trough having a base portion extending beneath said ash chamber for substantially the full plan area of said ash chamber, a first side portion disposed to one side of and above said base portion and extending along a first side of said ash chamber for substantially the full depth and height of said ash chamber, and a second side portion extending along a second side of said ash chamber, opposite said first side portion, for substantially the full depth and height of said ash chamber, and wherein said pre-heating means comprises a first conduit extending upwards adjacent a first side of said door aperture, a second conduit extending upwards adjacent the other side of said door aperture, and a transverse conduit extending above said aperture and delivering pre-heated air to said fire-box, said first and second conduits communicating respectively with said first and second side portions of said air chamber and with said transverse conduit.

2. The appliance according to claim 1, wherein said ash chamber is defined by a base wall and two side walls of said U-shaped trough, and wherein those said walls of said trough also define in part said air space for pre-heating air.

3. The appliance according to claim 2, wherein the side and base walls of said trough meet a front wall of the appliance.

4. The appliance according to claim 2, in which the side and base walls of said trough extend front to back of the appliance for the full depth of said ash chamber.

5. The appliance according to claim 1, and further comprising an ash pan, wherein said trough is of a uniform cross-section which cooperates with said ash pan.

6. The appliance according to claim 5, wherein said ash pan is in sliding engagement with said trough.

7. The appliance according to claim 1, wherein said ash chamber is defined by raised portions of said air chamber.

8. The appliance according to claim 1, wherein portions of said air chamber are disposed along either side of said ash chamber and are adapted to support said grate means.

9. The appliance according to claim 8, wherein said portions of said air chamber are raised above a central portion of said air chamber.

* * * * *

UNITED STATES PATENT AND TRADEMARK OFFICE

CERTIFICATE OF CORRECTION

PATENT NO. : 5,657,742

DATED : August 19, 1997

INVENTOR(S) : Jonathan Greenall

It is certified that error appears in the above-indentified patent and that said Letters Patent is hereby corrected as shown below:

On the Title page, in the Notice section, please change "5,496,836" to --5,469,836--.

Signed and Sealed this

Twenty-eighth Day of July, 1998

Bruce Lehman

*Attest:*

BRUCE LEHMAN

*Attesting Officer*

*Commissioner of Patents and Trademarks*